US007121988B2

(12) United States Patent
Walkerdine

(10) Patent No.: US 7,121,988 B2
(45) Date of Patent: Oct. 17, 2006

(54) WEIGHT-TRAINING APPARATUS HAVING SELECTABLE WEIGHT PLATES

(75) Inventor: Kenneth M. Walkerdine, Rochester Hills, MI (US)

(73) Assignee: D.K.B. Group, LLC, South Lyons, MI (US)

( * ) Notice: Subject to any disclaimer, the term of this patent is extended or adjusted under 35 U.S.C. 154(b) by 64 days.

(21) Appl. No.: 11/044,410

(22) Filed: Jan. 27, 2005

(65) Prior Publication Data

US 2006/0189458 A1 Aug. 24, 2006

(51) Int. Cl.
*A63B 21/072* (2006.01)
*A63B 21/075* (2006.01)
*A63B 21/062* (2006.01)
*A63B 23/16* (2006.01)

(52) U.S. Cl. ..... 482/106; 482/50; 482/101; 482/107; 482/108; 482/908

(58) Field of Classification Search ..... 482/105–109, 482/908
See application file for complete search history.

(56) References Cited

U.S. PATENT DOCUMENTS 5,628,716 A * 5/1997 Brice ..... 482/106
5,637,064 A 6/1997 Olson et al.
5,769,762 A 6/1998 Towley, III et al.
5,839,997 A * 11/1998 Roth et al. ..... 482/107
5,876,313 A 3/1999 Krull
5,967,952 A * 10/1999 Bronstein et al. ..... 482/111
6,186,927 B1 2/2001 Krull
6,322,481 B1 * 11/2001 Krull ..... 482/107
6,422,979 B1 7/2002 Krull
6,500,101 B1 * 12/2002 Chen ..... 482/107
6,669,606 B1 12/2003 Krull
6,719,674 B1 * 4/2004 Krull ..... 482/106
6,746,381 B1 * 6/2004 Krull ..... 482/108

(Continued)

FOREIGN PATENT DOCUMENTS

RU 1258-447 A 9/1986
RU 1389-789 A 4/1988

OTHER PUBLICATIONS

ND-552 Owner's Manual entitled Nautilus SelectTech Dumbell dated 2003.

(Continued)

*Primary Examiner*—Stephen R. Crow
*Assistant Examiner*—Arun S. Chhabra
(74) *Attorney, Agent, or Firm*—Rader, Fishman & Grauer PLLC

(57) ABSTRACT

An adjustable weight-training apparatus is provided having a plurality of weight plates, each of the weight plates including a protrusion. The weight-training apparatus has longitudinally opposing ends, each of the ends having longitudinally outer and inner groups of weight plates. A rotatable bar is also included in the apparatus and includes an inner control shaft and an outer control shaft. The inner control shaft is configured to rotate within the outer control shaft. The rotatable bar is configured to rotate within central holes of the weight plates. The inner control shaft has a first plurality of longitudinally spaced lobes. The inner control shaft is rotatable to position selected ones of the first plurality of lobes in engagement with the protrusions of selected weight plates of at least one of the outer groups of weight plates. The outer control shaft has a second plurality of longitudinally spaced lobes. The outer control shaft is rotatable to position selected ones of the second plurality of lobes in engagement with the protrusions of selected weight plates of at least one of the inner groups of weight plates.

30 Claims, 12 Drawing Sheets

U.S. PATENT DOCUMENTS

| | | | | |
|---|---|---|---|---|
| 6,749,547 | B1 | 6/2004 | Krull | |
| 2004/0005968 | A1 | 1/2004 | Crawford et al. | |
| 2006/0035767 | A1* | 2/2006 | Ekhaus | 482/108 |

OTHER PUBLICATIONS

Operational Instructions for Versa-Bell, no date.

* cited by examiner

WEIGHT-TRAINING APPARATUS HAVING SELECTABLE WEIGHT PLATES

FIELD OF THE INVENTION

The present invention relates generally to weight-training apparatuses and machines and, more particularly, to a weight-training apparatus having a pair of mechanisms for selecting and locking a plurality of self-contained weight plates to a bar.

BACKGROUND OF THE INVENTION

Weight training is a popular physical fitness activity for aiding in the maintenance of one's overall physical health. A variety of weight-training exercises may be accomplished by employing any number of machines or apparatuses. Typically, these machines and apparatuses are large and bulky and may require a number of heavy weight plates as well as large frames, cables, and pulleys for their proper use. These machines and apparatuses are so large, in fact, that many of them are found only in health and fitness clubs. However, variations of these larger machines and apparatuses have been redesigned and adapted for home use.

One such apparatus is the dumbbell. In the past, there were generally two ways to exercise using dumbbells. The first involves coupling individual weight plates to a stand alone bar. Typically, a pair of weight plates are positioned on a bar at opposing ends, leaving a distance between the plates for a user to grasp the bar with their hand. Collars, or the like, are then positioned on the bar at the base of the weight plates and tightened to the bar to secure the plates to the bar. While weight plates can be adequately secured to the bar in this manner, users find the securement means to be rather cumbersome and time consuming, especially when having to change weight plates multiple times, to a point where some users omit the collars during an exercise, preferring to risk losing a weight plate from the bar and damaging property or, much worse, causing injury.

A second way of using dumbbells to exercise is to select from a number of differently weighted dumbbells for a particular exercise. Typically, a large area, such as that of a health club gym, is required to store a variety of dumbbell pairs at different weights. While this is quicker than changing weight plates, storing a number of differently weighted dumbbells for personal use is inefficient and impractical.

A new dumbbell system was developed to alleviate some of the above concerns and limitations of the present dumbbells. U.S. Pat. No. 5,839,997 ("the '997 patent") entitled "Weight-Lifting Apparatus and Method" discloses an entire dumbbell system comprising a bar, a number of separately selectable weight plates, a tray, and a means of selecting the desired amount of weight for exercising. In this particular invention, a dial is included on the bar that allows the user to select the desired weight. As the user removes the dumbbell from the tray, only the selected amount of weight is coupled to the bar, the remaining weight plates being left behind in the tray. For example, each of the individual weight plates weighs two and one-half pounds. A pair of weights, at opposing ends of the bar, has a combined weight of five pounds. The '997 patent illustrates 10 weight plates, five plates on each side of the grip, on a single bar. In a specific commercial embodiment of the '997 patent, a person could select any number of weight plates from zero (the bar itself, without weight plates attached, weighs five pounds) to 10 (30 pounds) in five pound increments. This invention avoided the problem of using collars to secure individual weight plates to bars as well as the problem of storing a number of differently weighted dumbbells. The weight plates are conveniently stored in a tray that is adapted to correctly position the weight bar in the tray in relation to the weights so that the user could select the desired total weight by adjusting the dial.

While a commercial embodiment of the '997 patent addresses the concerns associated with the prior ways of exercising with dumbbells, the maximum weight of the dumbbell pairs of that commercial embodiment is limited to only 30 pounds for each dumbbell. This maximum weight limit of 30 pounds may be enough weight for a specific portion of the population, but another portion of the population, the larger weight trainers, requires more than the 30-pound dumbbells offered by that system.

Another prior art dumbbell that addresses the need to have a greater range of weight plates to select does so by substantially increasing its length to accommodate more weight plates. This dumbbell is too large and cumbersome even for the most experienced weight trainers. When performing certain exercises that require two dumbbells to be used at the same time, side-by-side and lengthwise, weight trainers find the prior art dumbbells to be uncomfortable and cumbersome because they are too long and bulky. Thus, weight trainers are unable to maximize their training efforts.

Therefore, a need exists for a weight-training apparatus that can increase the amount of weight available for training while at the same time providing an apparatus that can be comfortably used while allowing the weight trainer to maximize his physical efforts.

SUMMARY OF THE INVENTION

An adjustable weight-training apparatus is provided comprising a plurality of weight plates, each of the weight plates including a protrusion. The weight-training apparatus has longitudinally opposing ends, each of the ends having longitudinally outer and inner groups of weight plates. A rotatable bar is also included in the apparatus and includes an inner control shaft and an outer control shaft. The inner control shaft is configured to rotate within the outer control shaft. The rotatable bar is configured to rotate within central holes of the weight plates. The inner control shaft has a first plurality of longitudinally spaced lobes. The inner control shaft is rotatable to position selected ones of the first plurality of lobes in engagement with the protrusions of selected weight plates of at least one of the outer groups of weight plates. The outer control shaft has a second plurality of longitudinally spaced lobes. The outer control shaft is rotatable to position selected ones of said second plurality of lobes in engagement with the protrusions of selected weight plates of at least one of the inner groups of weight plates.

BRIEF DESCRIPTION OF THE DRAWINGS

The features and inventive aspects of the present embodiments will become more apparent upon reading the following detailed description, claims, and drawings, of which the following is a brief description:

DETAILED DESCRIPTION

Figure 1A:
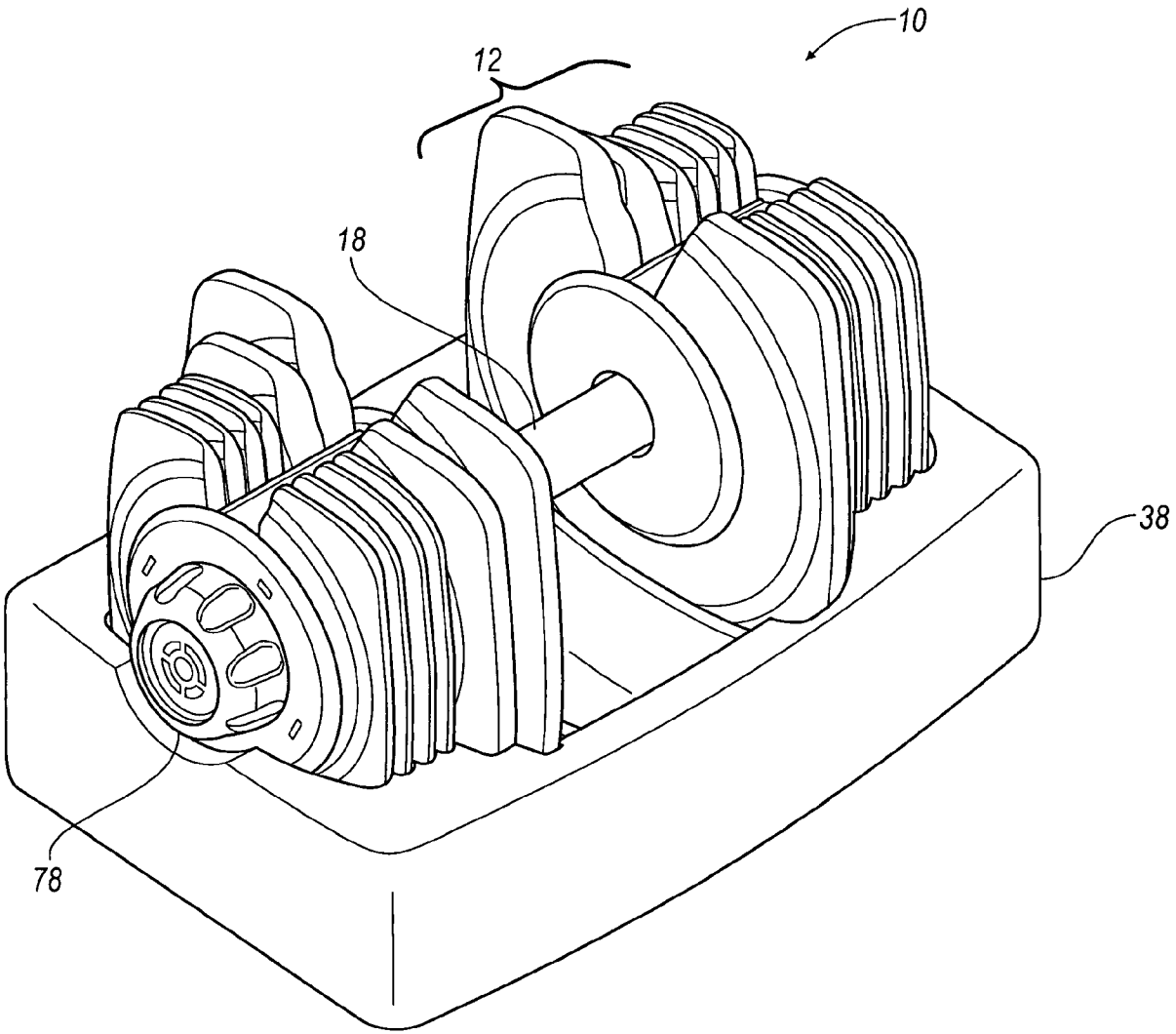
FIG. 1A is a perspective view of the weight-training apparatus and a holder according to an embodiment of the present invention.

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

Figure 1B:
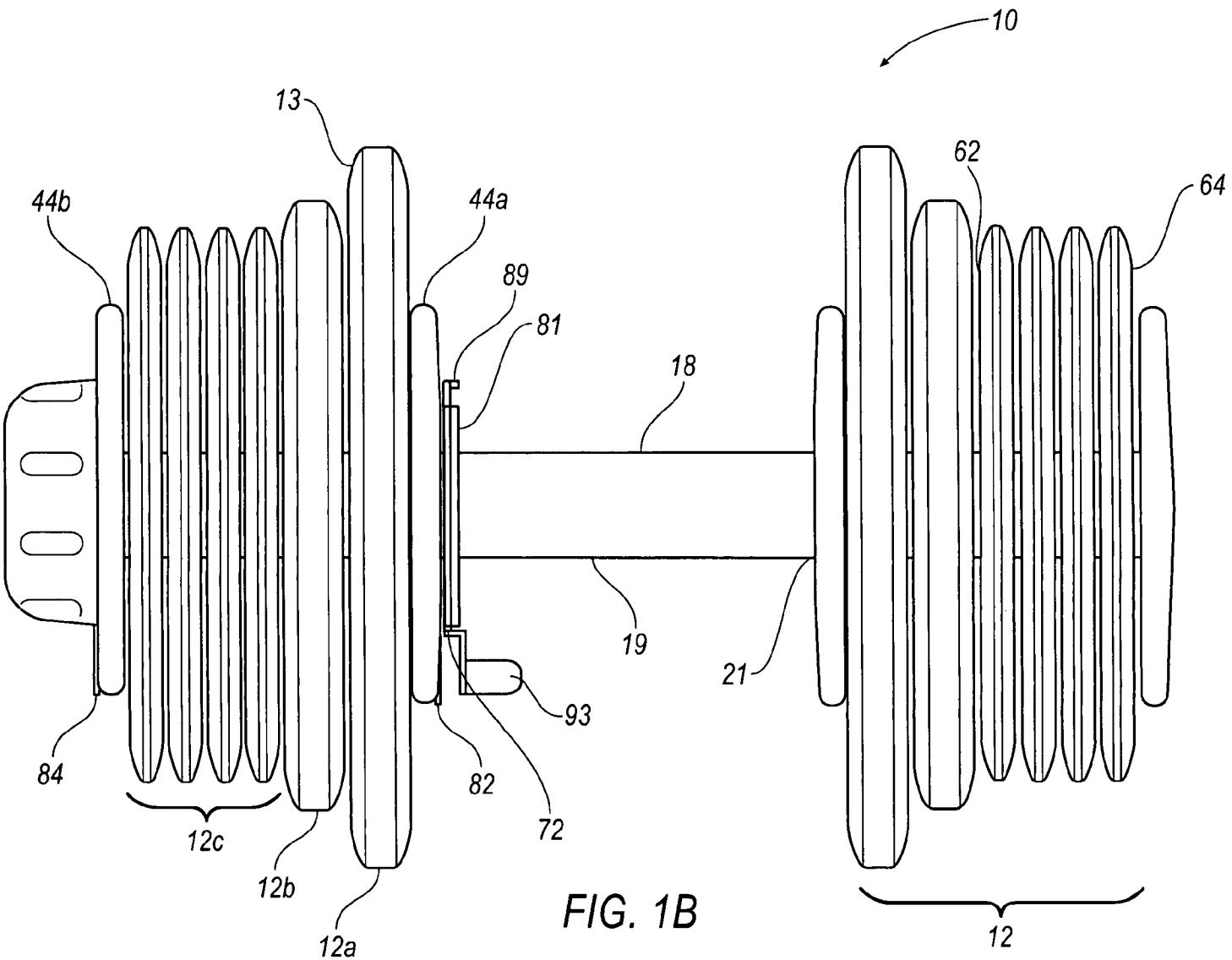
FIG. 1B is a side view of the weight-training apparatus of FIG. 1A.

FIG. 1A illustrates a weight-training apparatus 10 and holder 38 according to an embodiment of the present invention. FIG. 1B illustrates a side view of weight-training apparatus 10 of FIG. 1A that is commonly used by people for regularly exercising their bodies to tone and develop various muscle groups in an effort to enhance their physical attributes and to maintain good health. In this particular embodiment, weight-training apparatus 10 is shown as a dumbbell, however, it is important to note that the elements described below for a dumbbell may be easily adapted to other weight-training apparatuses such as barbells, curling bars, etc.

Now referring to FIGS. 1A–2C, weight training apparatus 10 includes a plurality of weight plates 12 each having a central hole 14 and a slot 16 extending from central hole 14 to a perimeter of the associated weight plate 12. Weight plates 12 may be of varying sizes and weights to provide a person with a wide variety of useable weight ranges. In this particular embodiment, three different sizes and weights of plates 12*a*, 12*b*, and 12*c* are employed.

Referring now to FIGS. 1A, 1B, 3, and 4, apparatus 10 further includes a bar 18, which is intended to be gripped when lifting apparatus 10, and comprises a sleeve 20 having opposing ends 22 and 24. Included within sleeve 20 are an outer shaft 26, having opposing ends 28 and 30 and sized to rotate freely within sleeve 20, and an inner shaft 32 sized to rotate freely within outer shaft 26. Inner shaft 32 is slightly longer than outer shaft 26 so that inner shaft extensions 34 and 36 may be coupled to either end of inner shaft 32, thereby capturing outer shaft 26 between extensions 34 and 36. Extensions 34 and 36 are secured to inner shaft 32 with fasteners 31, such as roll pins, spirol pins, or screws, that are positioned in holes 37. Opposing ends 28 and 30 of outer shaft 26 terminate at extensions 34 and 36 of inner shaft 32 so as not to conceal extensions 34 and 36. Also, the outer diameters of shaft extensions 34 and 36 may be equal to the outer diameter of outer shaft 26 to ensure a uniform size for rotation within sleeve 20.

Figure 2C:
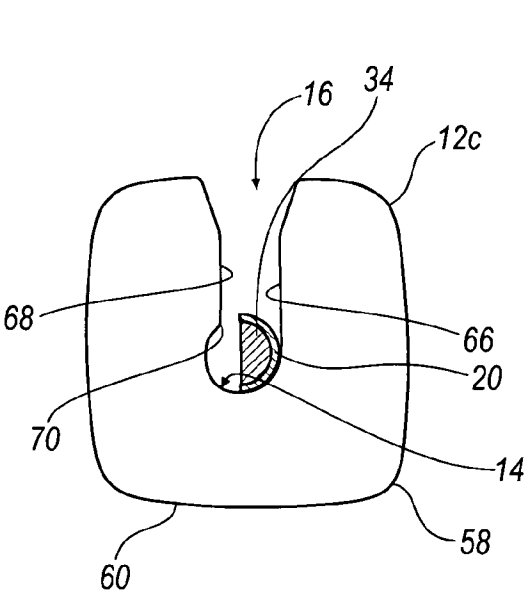
FIGS. 2A–2C are partially sectional views of the weight-training apparatus shown in FIG. 1A, showing individual weight plates and the supporting sleeve and shafts, taken at three longitudinally-spaced locations on the apparatus.
Figure 2B:
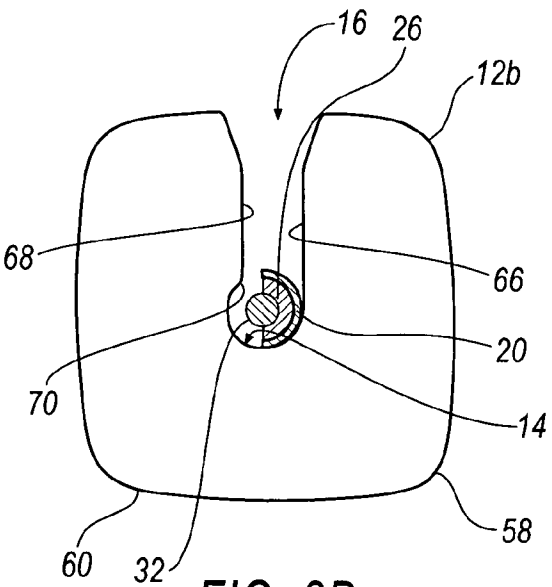
Figure 2A:
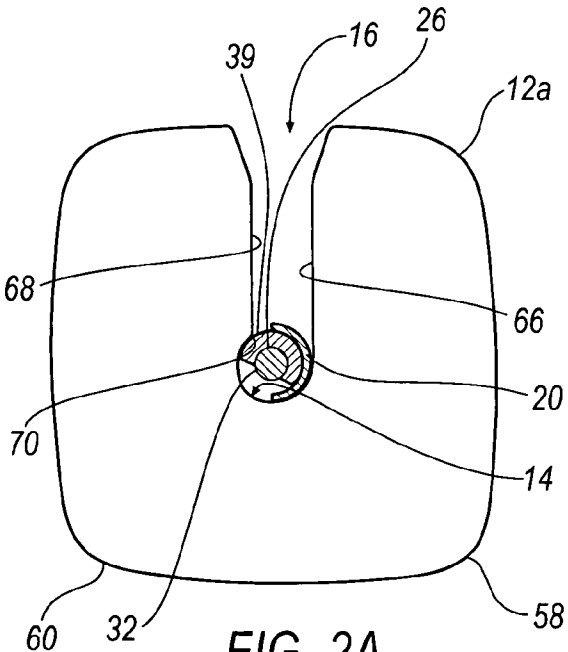

Referring now also to FIGS. 2A–2C, weight plates 12 are preferably square shaped having rounded corners 58 for safety and a generally flat bottom surface for sure storage in holder 38. The thickness of the plates is dependent upon the material used in manufacturing the plates (for example, steel or zinc) and upon the desired weight. In addition, slot 16 of weight plates 12 is initially defined by hole 14, which is positioned in the center of plates 12. The sides of slot 16 are defined by tangential side 66 and a second side 68 that is parallel to tangential side 66 but is spaced inboard from a tangential position relative to hole 14. The intersection of second side 68 and hole 14 defines interference protrusion 70.

The width of slot 16 and diameter of hole 14 are sized to allow the rotation of outer shaft 26 and extensions 34 and 36. Outer shaft 26 rotates within hole 14 of the heavier weight plates 12*a* and 12*b*. Extensions 34 and 36 may be rotated, separately from outer shaft 26 by inner shaft 32, within hole 14 of the lighter weight plates 12*c*. Outer shaft 26 and extensions 34 and 36 include lobes 39 and 41, respectively, as explained further below, for engaging interference protrusion 70 of weight plates 12. Outer shaft 26 and extensions 34 and 36 are rotatable in a first direction within hole 14 of weight plates 12 so that lobes 39 and 41 may engage protrusion 70 to lock weight plates 12 to bar 18 (see e.g. FIG. 2A). Outer shaft 26 and extensions 34 and 36 are independently rotatable to various positions to allow for the selection of the desired amount of weight by the user. Outer shaft 26 and extensions 34 and 36 are rotatable in a second direction within hole 14 of weight plates 12 so that lobes 39 and 41 may disengage protrusion 70 to unlock weight plates 12 from bar 18 (see e.g. FIGS. 2B and 2C). When lobes 39 and 41 are disengaged from protrusions 70, the width of outer shaft 26 as well as inner extensions 34 and 36 in combination with sleeve 20 is less than the width of slot 16, thereby allowing apparatus 10 to be upwardly removed from holder 38 via slots 16 of the disengaged weight plates 12, without any such disengaged weight plates locked to bar 18.

Figure 5:
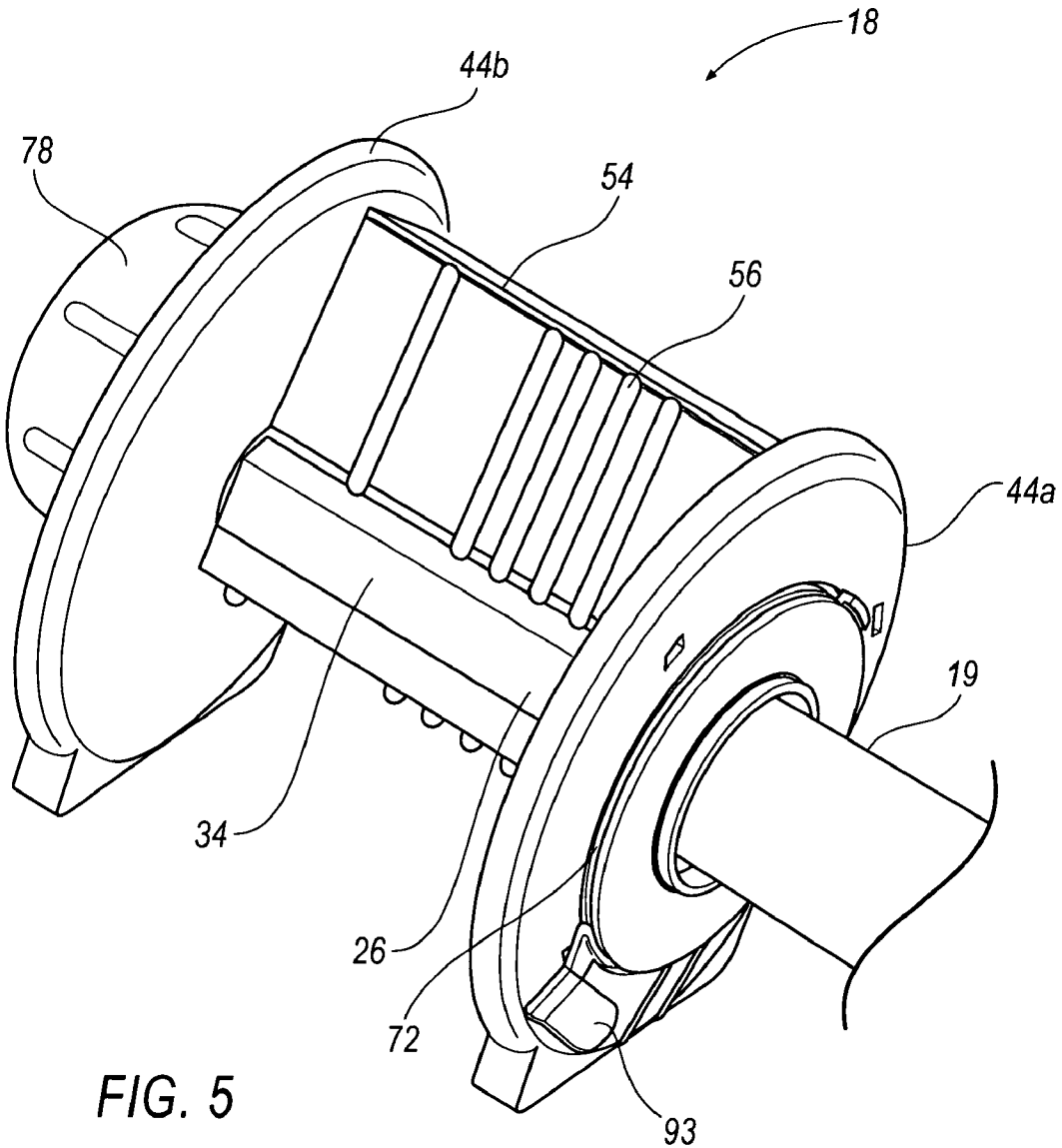
FIG. 5 is a fragmentary perspective view of one end of the bar of the weight-training apparatus of FIG. 1A shown without weight plates.
Figure 5A:
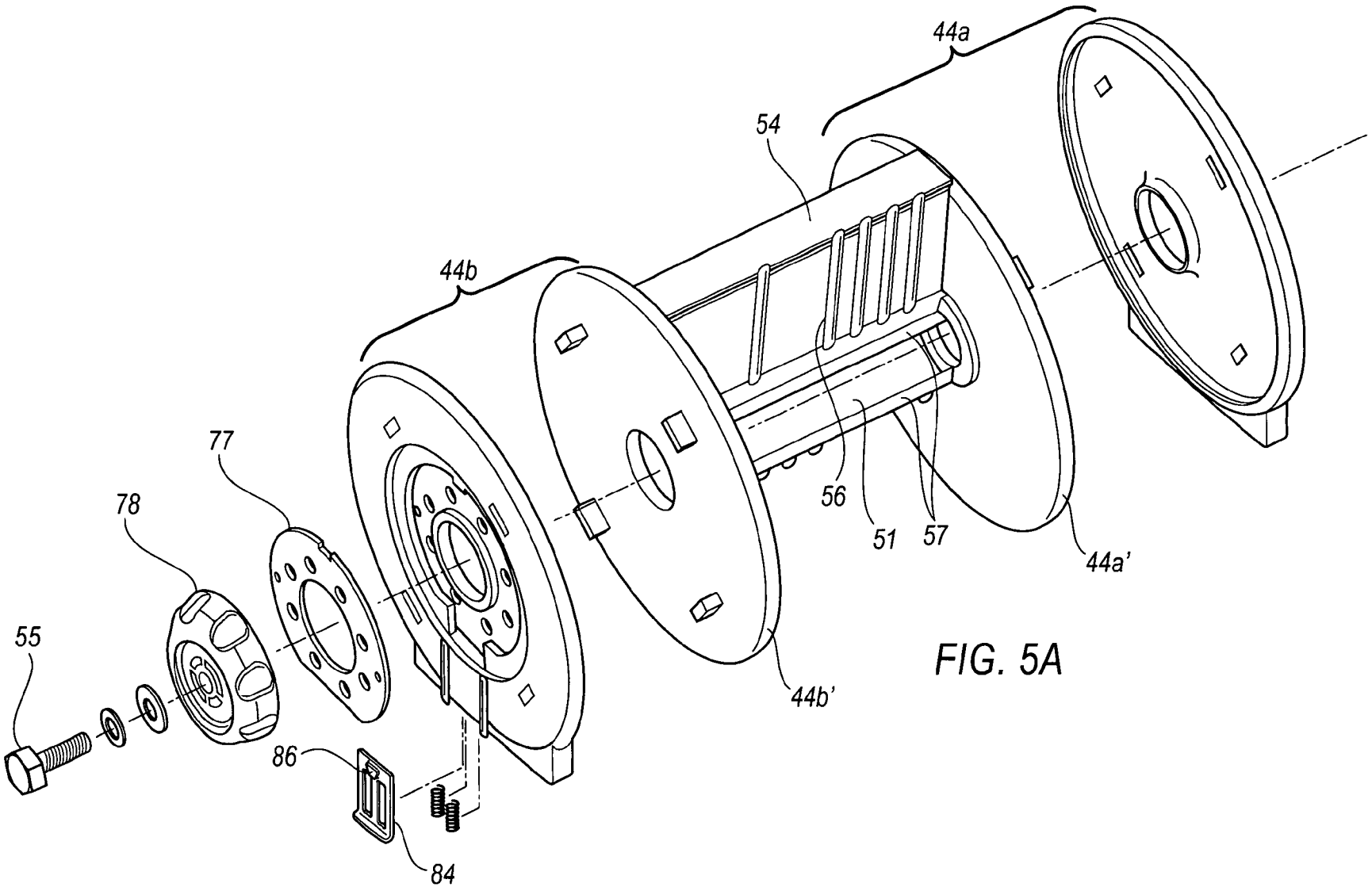
FIG. 5A is an exploded view of one end of the bar of the weight-training apparatus of FIG. 1A shown without weight plates.

As illustrated by FIGS. 1A, 1B, 5, and 5A, bar 18 includes a plurality of dividers 44 to prevent axial movement of weight plates 12*a*, 12*b*, and 12*c* on the bar. Dividers 44 are generally circular and extend outwardly from bar 18 to provide an adequate surface area to abut weight plates 12. Positioned on each end of bar 18 are an interior divider 44*a* and an exterior divider 44*b*. Disposed between interior and exterior dividers 44*a* and 44*b* is an alignment fin 54 that extends longitudinally along bar 18 and radially outwardly from sleeve 20 to the outer perimeters of dividers 44 (FIG. 5A is an exemplary assembly of one end of bar 18 showing fin 54 disposed between dividers 44*a* and 44*b*). Interior and exterior dividers 44*a* and 44*b* as well as fin 54 are preferably formed of a composite polymeric material, such as nylon or plastic, and may be manufactured by well know plastic injection molding techniques. Each interior and exterior divider 44*a* and 44*b* is manufactured in two halves, one half including tabs and its mating half including slots so that the halves may be press-fit or snap-fit to each other to form a single divider (see FIG. 5A). Fin 54 is disposed between one half of interior and exterior dividers 44*a*' and 44*b*' and the entire unit is manufactured as one.

Each fin 54 includes a bottom portion 51 that extends the longitudinal length of fin 54 and is shaped to follow the outer circumference of sleeve 20 such that fin 54 may be slid onto sleeve 20. Bottom portion 51 includes lips 57 that extend the length of bottom portion 51. Each upper and lower lip 57 includes a return that extends radially inwardly and is configured to abut edges of channels 48 when fins 54 are properly positioned on sleeve 20. The abutment between lips 57 and the edges of channel 48 prevent the relative rotation of fins 54 and sleeve 20. The width of fins 54 is slightly less than the width of slots 16, to allow those weight plates 12 not locked to bar 18 to slide on and off bar 18 when weight-training apparatus 10 is removed or replaced in holder 38. Fins 54 may include guide ribs 56 that allow weight plates 12 to be easily aligned and located on bar 18 so that weight plates 12 are in the proper position for locking to bar 18 as well as preventing weight plates 12 from contacting each other and preventing unwanted clanging noises during use. Fins 54 also function to prevent the rotation of weight plates 12 about the axis of bar 18.

Interior dividers 44*a* are spaced apart on the innermost portion of bar 18 to provide a gripping area 19 that allows a person to easily grasp weight-training apparatus 10. Gripping area 19 may include shoulders 21 at opposing ends to provide an abutment for interior dividers 44*a* to prevent them from moving inward and encroaching on the hand of the user. Gripping area 19 may be covered in a material, such as rubber, to provide the user with assistance in gripping apparatus 10

Weight plates 12 further include generally flat faces 62 and 64 and abut each other or dividers 44*a* and 44*b*, depending on their location on bar 18, to minimize the spacing between weight plates 12. Interior dividers 44*a* also ensure that weight plates 12 will not slide into the hand during use. Exterior dividers 44*b* are prevent weight plates 12 from sliding off of bar 18. Each weight plate 12 has a beveled outer edge 13 to limit the surface area of weight plates 12 to minimize interference between adjacent selected and non-selected weight plates during use.

Figure 6A:
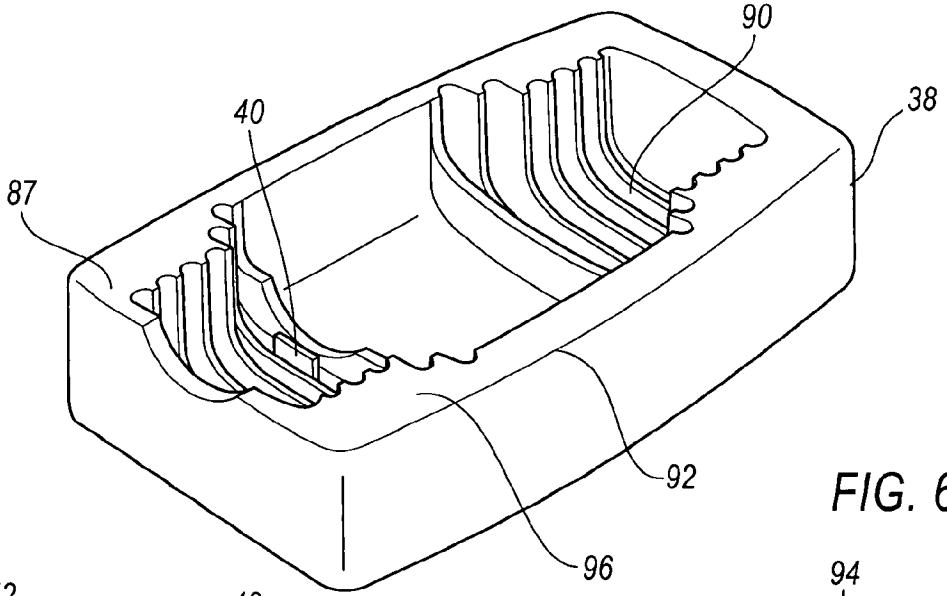
FIG. 6A is a perspective view of the holder shown in FIG. 1A.
Figure 6B:
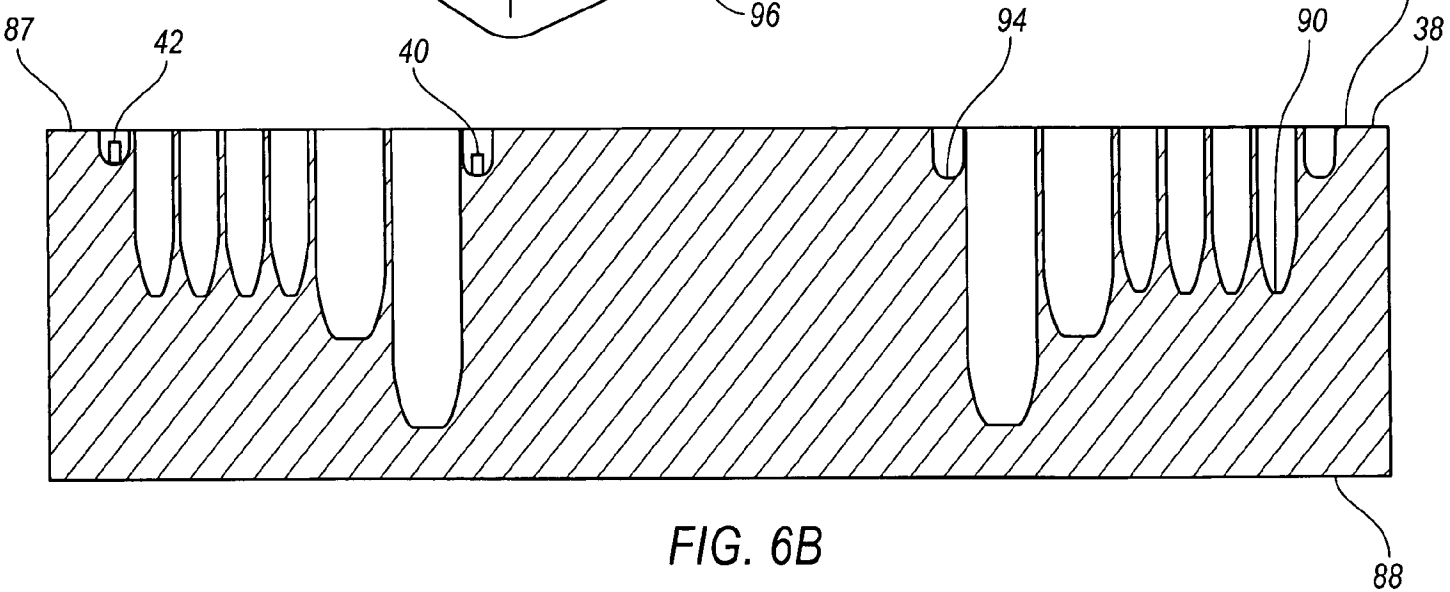
FIG. 6B is a cross-sectional view of the holder of FIGS. 1A and 6A.

Provided with weight-training apparatus 10 is a tray or holder 38, as illustrated in FIGS. 1A, 6A, and 6B, which is configured to store apparatus 10. Holder 38 includes a number of depressions 90 to house each weight plate 12 separately. Holder 38 is also configured to store each weight plate 12 that has not been selected for use on bar 18 when weight-training apparatus 10 is removed from holder 38. To prevent weight plates 12 from being dropped from weight-training apparatus 10 when it is removed from holder 38, outer shaft 26 and inner shaft 32 are locked and prevented from rotating while weight-training apparatus 10 is out of holder 38. For that purpose, holder 38 further includes two release mechanisms 40 and 42 (further explained below) that allow outer shaft 26 and inner shaft 32 to rotate only while weight-training apparatus 10 is resting in holder 38. In addition to minimizing interference between adjacent selected and non-selected weight plates during use, beveled outer edge 13 of weight plates 12, also minimizes interference between adjacent selected and non-selected weight plates as the apparatus is returned to holder 38.

Now referring again to FIGS. 3 and 4, opposing ends 22 and 24 of sleeve 20 each include a channel 48. Channels 48 are sized to expose opposing ends 28 and 30 of outer shaft 26 and inner shaft extensions 34 and 36 of inner shaft 32. (FIGS. 2A–2C depict sleeve 20 in its operational orientation, with channels 48 opening sidewards. The upward-opening orientation of sleeve 20 depicted in FIGS. 3 and 4 was chosen so that other elements of apparatus 10 could be easily displayed). Extensions 34 and 36 have a plurality of lobes 41 and corresponding recessed surfaces 50 that extend different longitudinal lengths. The different lengths of lobes 41 and recessed surfaces 50 correspond to the different weight-plate selecting positions to which extensions 34 and 36 may be rotated. As inner shaft 32 is rotated, lobes 41 and recessed surfaces 50 are successively exposed through channel 48 and are selectively positionable to either allow lobes 41 to engage protrusion 70 of hole 14 of one or more weight plates 12*c* (to secure the selected pairs of weight plates to bar 18) or to allow recessed surfaces 50 to slide upward along slot 16, thus selectively releasing one or more pairs of weight plates 12*c* as bar 18 is removed from holder 38. Depending on the length of the particular lobes 41 and corresponding recessed surfaces 50 that have been rotated into the selected operational position, a different number of weight plates 12*c* will be locked or released from bar 18. Bar 18 will release the longitudinally outermost weight plates 12*c* first because those plates correspond to lobes 41 with the longest length and recessed surfaces 50 with the shortest length.

Opposing ends 28 and 30 of outer shaft 26 also include lobes 39 as well as recessed surfaces 52 that extend different longitudinal lengths. The different lengths of lobes 39 and recessed surfaces 52 correspond to the different weight plate-selecting positions to which outer shaft 26 may be rotated. As outer shaft 26 is rotated, lobes 39 and recessed surfaces 52 are successively exposed through channels 48 and are selectively positionable to either engage protrusion 70 of hole 14 of one or more weight plates 12*a* and 12*b* (to secure the selected pairs of weight plates to bar 18) or to allow outer shaft 26 to slide upward along slot 16, thus selectively releasing one or more weight plates 12*a* and 12*b* as bar 18 is removed from holder 38. Depending on the rotational position of outer shaft 26 and the length of lobes 39 and recessed surfaces 52, a different number of weight plates 12*a* and 12*b* will be locked or released from bar 18.

Figure 4:
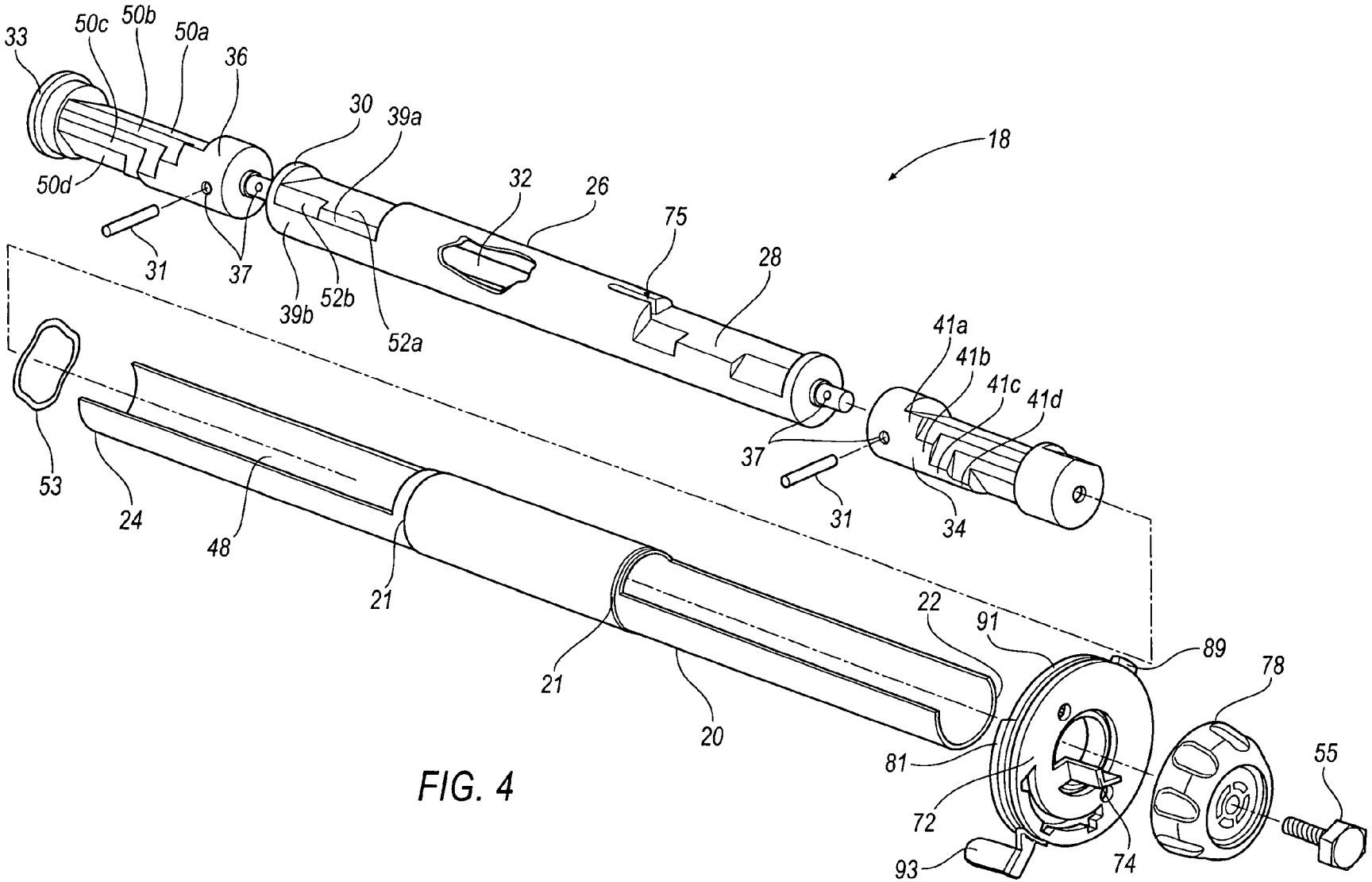
FIG. 4 is an exploded view of the bar shown in FIG. 3.

As illustrated by the exploded view of bar 18 in FIG. 4, weight-training apparatus 10 further includes a resiliently compressible member 53, such as a wave washer or resiliently compressible o-ring or washer, which is positioned between exterior divider 44*b* and end 33 of shaft extension 36. In this particular embodiment, compressible member 53 is a wave washer and is used to compensate for any longitudinal assembly tolerance differences from apparatus to apparatus and to limit the axial movement of bar 18 in relation to weight plates 12. An exterior selector ring 78, such as a dial or thumb lever actuator, is positioned and secured, for example, with a fastener 55 to extension 34 of inner shaft 32 for rotation therewith and to secure the assembly of weight-training apparatus 10. In this particular embodiment, exterior selector ring 78 is a dial. Compressible member 53 also prevents the overtightening of apparatus 10 during assembly that may produce excessive friction and prevent the rotation of the inner and outer shafts.

Figure 4A:
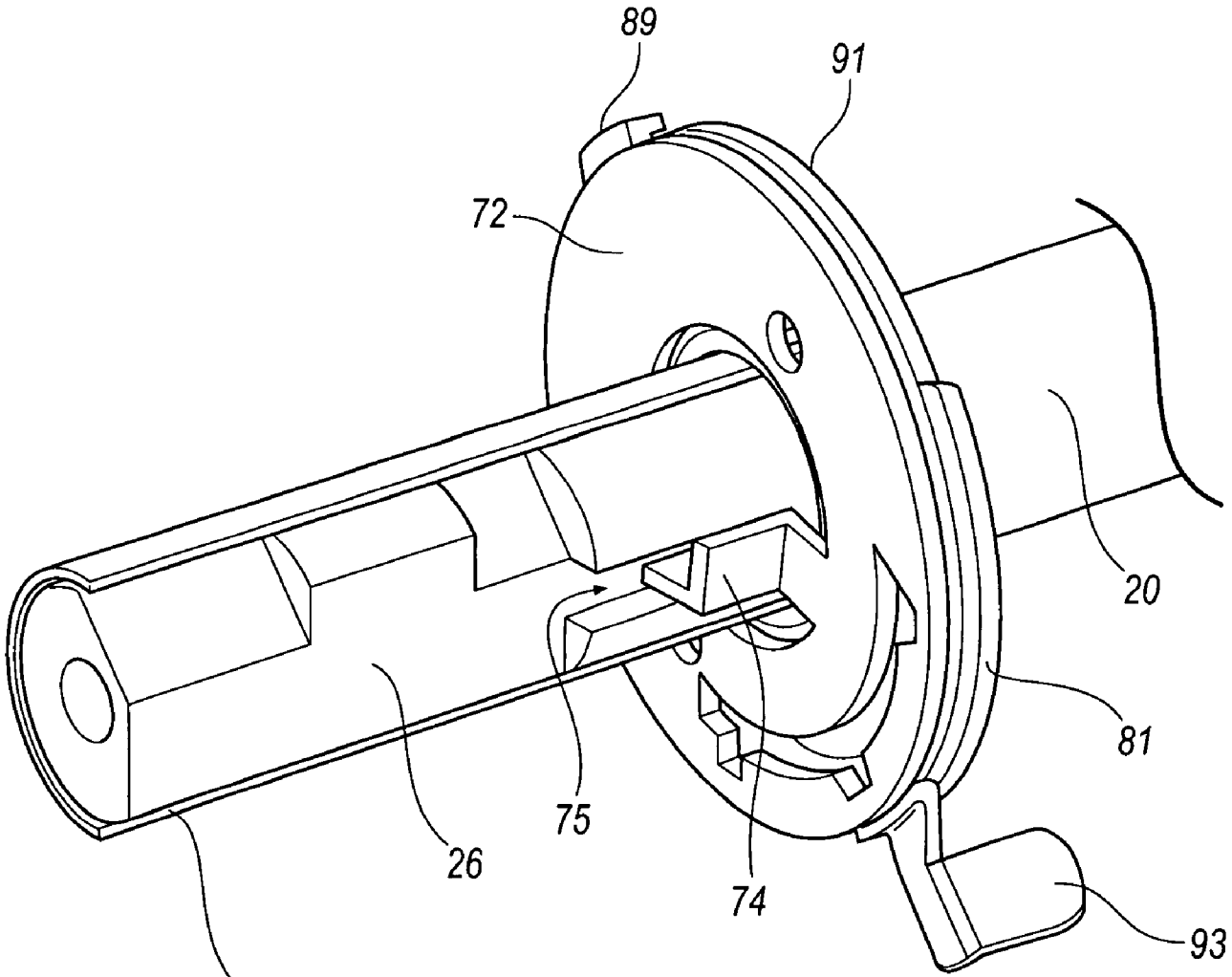
FIG. 4A is a fragmentary perspective view of an interior dial shown being assembled to the bar of the weight-training apparatus of FIG. 1A.

Outer shaft 26 may be rotated by an interior selector ring 72 (see FIGS. 4A, 5, and 7), such as a selector dial or a thumb lever actuator, to select a number of weight plates 12*a* and 12*b* that will correspond to the desired weight for training. In this particular embodiment, interior selector ring 72 is actuated by a thumb lever 93. FIG. 4A illustrates the assembly of interior selector ring 72 to bar 18. Interior selector ring 72 includes a tab 74 that is configured to be inserted into notch 75 of outer shaft 26. Further included with interior selector ring 72 is a cover 81 configured on bar 18 to encase the interior selector ring. Thumb lever 93 of interior selector ring 72 cooperates with lower cut-out (not shown) of cover 81 to ensure that interior selector ring 72 may not be rotated about sleeve 20 too far in one direction or another. Interior selector ring 72 further includes a second tab 89 that cooperates with an upper cut-out 91 of cover 81 also to ensure that interior selector ring 72 may not be rotated about sleeve 20 too far in one direction or another. Positioned between cover 81 and interior selector ring 72 is a second resiliently compressible member (not shown), such as a cup washer, used to ensure that apparatus 10 is not overtightened during assembly, thereby prohibiting the movement of interior selector ring 72. Channel 48 is sized such that interior selector ring 72 may rotate outer shaft 26 within sleeve 20 to select any number of weight plates 12*a* and 12*b*. As interior selector ring 72 is rotated, outer shaft 26 correspondingly rotates to position the necessary number of lobes 39 to engage protrusions 70 according to the desired amount of weight that is to be lifted, while sleeve 20 and inner shaft 32 remain stationary.

Figure 7C:
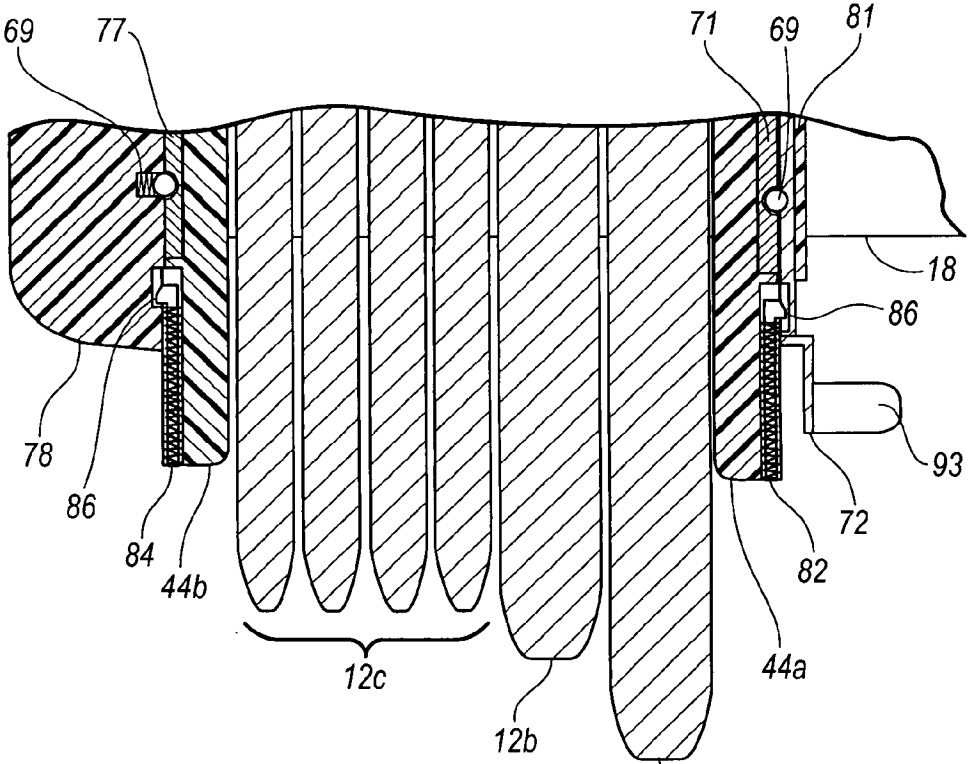
FIG. 7C is a fragmentary cross-sectional view of the bar and the weight plates shown in FIG. 1B.
Figure 7A:
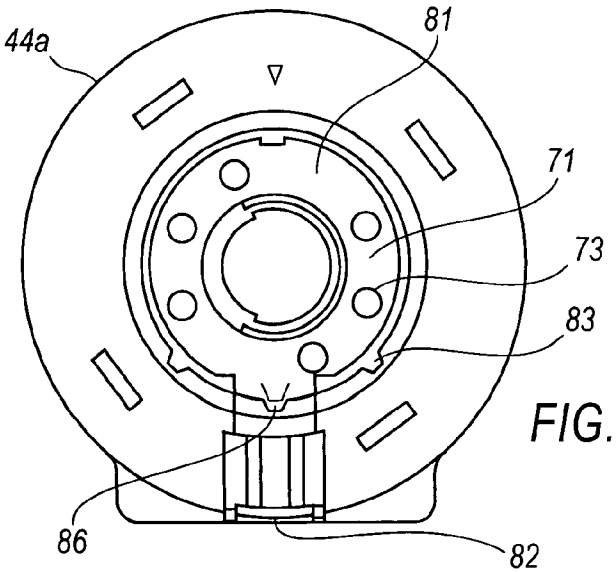
FIG. 7A is a rear view of an interior selector dial of the weight-training apparatus shown in FIG. 1A as seen from the side abutting an interior divider.
Figure 7B:
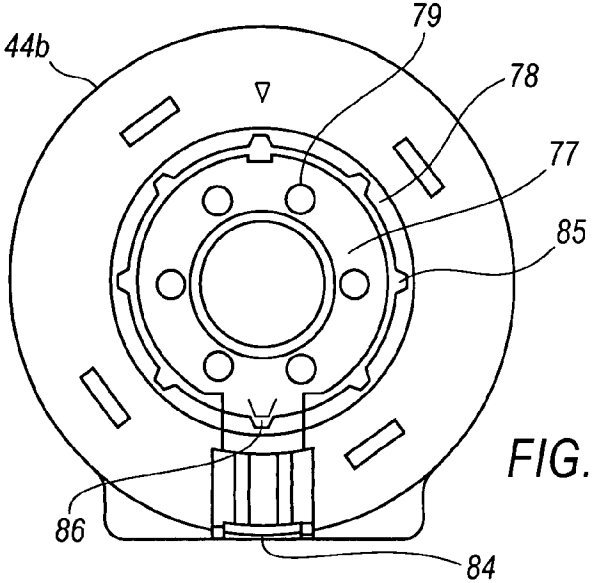
FIG. 7B is a rear view of an exterior selector dial of the weight-training apparatus shown in FIG. 1A as seen from the side abutting an exterior divider.

FIGS. 7A and 7B illustrate the interior faces of both interior selector ring 72 and exterior selector dial 78 that abut dividers 44*a* and 44*b*, respectively. Also illustrated in FIG. 7C is a cross-sectional view of bar 18, plates 12, dividers 44 as well as interior selector ring 72 and exterior selector dial 78. As illustrated in FIGS. 7A and 7C, a face plate 71 is fastened to divider 44*a*. Interior selector ring 72, cooperatively with face plate 71, rotates and positions outer shaft 26 such that lobes 39 engage protrusions 70 of weight plates 12*a* and/or 12*b*. A single interior selector ring 72 controls the rotation of outer shaft 26 such that weight plates 12*a* and/or 12*b*, positioned at both opposing ends 28 and 30, may be secured to outer shaft 26 by activating the single interior selector ring.

Interior selector ring 72 includes a detent 69 that interfaces with a number of circumferentially spaced dimples 73 on face plate 71 as ring 72 is rotated about outer shaft 26 and face plate 71. Detent 69 may be positioned in a single dimple 73 such that lobes 39 will be in engagement with protrusions 70 of weight plates 12*a* and/or 12*b*. Detent 69, as it is moved into position in dimple 73, provides the user positive feedback that weight plates 12*a* and/or 12*b* are locked to bar 18. Detent 69 also allows the user to rotate interior selector ring 72 by applying a force to overcome the detent, yet helps to ensure that outer shaft 26 is held in the selected position when weight-training apparatus is removed from holder 38. Detent 69 may be any suitable detent such as, for example, indentations formed in interior selector ring 72 or a ball and socket detent configured to engage the series of corresponding dimples 73 of face plate 71. The detented positions of interior selector ring 72 correspond to the number of various combinations of weight plates 12*a* and 12*b* that may be selected. In his particular embodiment, two heavier weight plates 12*a* and 12*b* are positioned at opposing ends 22 and 24 of sleeve 20. Preferably, to aid the user in selecting a weight, interior selector ring 72 is marked with numbers or other indicia according to these detent positions to indicate the weight added to weight-training apparatus 10.

In a similar manner as described above and illustrated in FIGS. 7B and 7C, inner shaft 32 may be rotated by exterior selector dial 78 to select a number of weight plates 12*c* that will correspond to the desired weight for training. As exterior selector dial 78 is rotated, inner shaft 32 correspondingly rotates to position the necessary number of lobes 41 to engage protrusions 70 according to the desired amount of weight that is to be coupled to bar 18, while sleeve 20 and outer shaft 26 remain stationary. A second face plate 77 is included in apparatus 10 that is fastened to divider 44*b*. Exterior selector dial 78, cooperatively with face plate 77, rotates and positions inner shaft 32 such that lobes 41 engage protrusions 70 of weight plates 12*c*. A single exterior selector dial 78 controls the rotation of inner shaft 32 such that weight plates 12*c*, positioned at both opposing ends 34 and 36, may be secured to inner shaft 32 by activating the single exterior selector dial.

Exterior dial selector 78 also includes a detent 69 that interfaces with a number of circumferentially spaced dimples 79 on face plate 77 as dial 78 is rotated about inner shaft 32 and face plate 77. Detent 69 may be positioned in a single dimple 79 such that lobes 41 will be in engagement with protrusions 70 of weight plates 12*c*. Detent 69, as it is moved into position in dimple 79, provides the user positive feedback that weight plates 12*c* are locked to bar 18. Detent 69 also allows the user to rotate exterior selector dial 78 by applying a force to overcome the detent, yet helps to ensure that inner shaft 32 is held in the selected position when weight-training apparatus is removed from holder 38. Detent 69 may be any suitable detent such as a spring-loaded ball and socket detent configured to engage the series of corresponding dimples 79. The detented positions of exterior selector dial 78 correspond to the number of various combinations of weight plates 12*c* that may be selected. In this particular embodiment, four lighter weight plates 12*c* are positioned at opposing ends 22 and 24 of sleeve 20. Preferably to aid the user in selecting a weight, exterior selector dial 78 is marked with numbers or other indicia according to these detent positions to indicate the weight added to weight-training apparatus 10.

Referring now to FIGS. 7A–7C, interior and exterior selector dials 72 and 78 further include circumferentially spaced recesses 83 and 85, respectively. Dividers 44*a* and 44*b* further include radially slideable locking members 82 and 84 having pins 86 for engaging recesses 83 and 85. The engagement of locking member 82 and 84 of dividers 44*a* and 44*b* with interior selector ring 72 and exterior dials 78 (pins 86 are positioned in recesses 83 and 85) prevents the rotation of outer shaft 26 and inner shaft 32 while weight-training apparatus 10 is out of holder 38, to prevent weight plates 12 from accidentally being unlocked from bar 18, dropping from apparatus 10, and having the potential to cause injury. As weight-training apparatus 10 is returned to holder 38, release projections 40 and 42 engage locking members 82 and 84, respectively. When weight-training apparatus 10 is properly situated in holder 38, fixed release projection 40 forces locking member 82 radially inward toward bar 18, thereby urging pin 86 out of recess 83 and allowing interior selector ring 72 to rotate outer shaft 26. In a similar manner, fixed release projection 42 forces locking member 84 radially inward toward bar 18, thereby urging pin 86 out of recess 85 and allowing exterior selector dial 78 to rotate inner shaft 32. Locking members 82 and 84 include at least one biasing member (for example, a spring) to return locking members 82 and 84 to a locking position (i.e. pin 86 is positioned in recesses 83 and 85) when weight-training apparatus 10 is removed from holder 38 once again.

Now referring to FIGS. 1A–7C, the various weight plates 12 may be selected and locked to bar 18 in the following manner. With weight-training apparatus 10 seated in holder 38, interior selector ring 72 and/or exterior selector dial 78 may be rotated to various detented positions to select the desired amount of weight with which to train. Both interior selector ring 72 and exterior selector dials 78 may begin in a selected position such that when bar 18 is removed holder 38 none of the weight plates 12 are locked to bar 18. The rotatable positions of both outer shaft 26 and inner shaft 32 are such that their transverse width across their respective recessed surfaces 50, 52 is less than the width of slot 16 (see e.g. FIGS. 2B and 2C), thereby allowing bar 18 to slide freely into and out of slot 16 of weight plates 12.

Interior selector ring 72 may be rotated in the first direction to rotate outer shaft 26 so that lobes 39 of the outer shaft at opposing ends 28 and 30 rotate into engagement with interference protrusions 70, thereby locking selected weight plates 12*a* and/or 12*b* to bar 18 (see e.g. FIG. 2A). As a result, when a user lifts weight-training apparatus 10 from holder 38, the locked weight plates 12*a* and/or 12*b* will be attached to bar 18 and secured for exercising purposes. Interior selector ring 72 may be rotated subsequent times in the first direction to lock any number of weight plates 12*a* and/or 12*b* to bar 18.

In a similar manner, exterior dial 78 may be rotated in the first direction also to rotate inner shaft 32 so that lobes 41 of inner shaft extensions 34 and 36 rotate into engagement with interference protrusion 70, thereby locking selected weight plates 12*c* to bar 18 (see e.g. FIG. 2A). As a result, when a user lifts weight-training apparatus 10 from holder 38, the locked weight plates 12*c* will be attached to bar 18 and secured for exercising purposes. Exterior selector dial 78 may be rotated subsequent times in the first direction to lock any number of weight plates 12*c* to bar 18.

Figure 3:
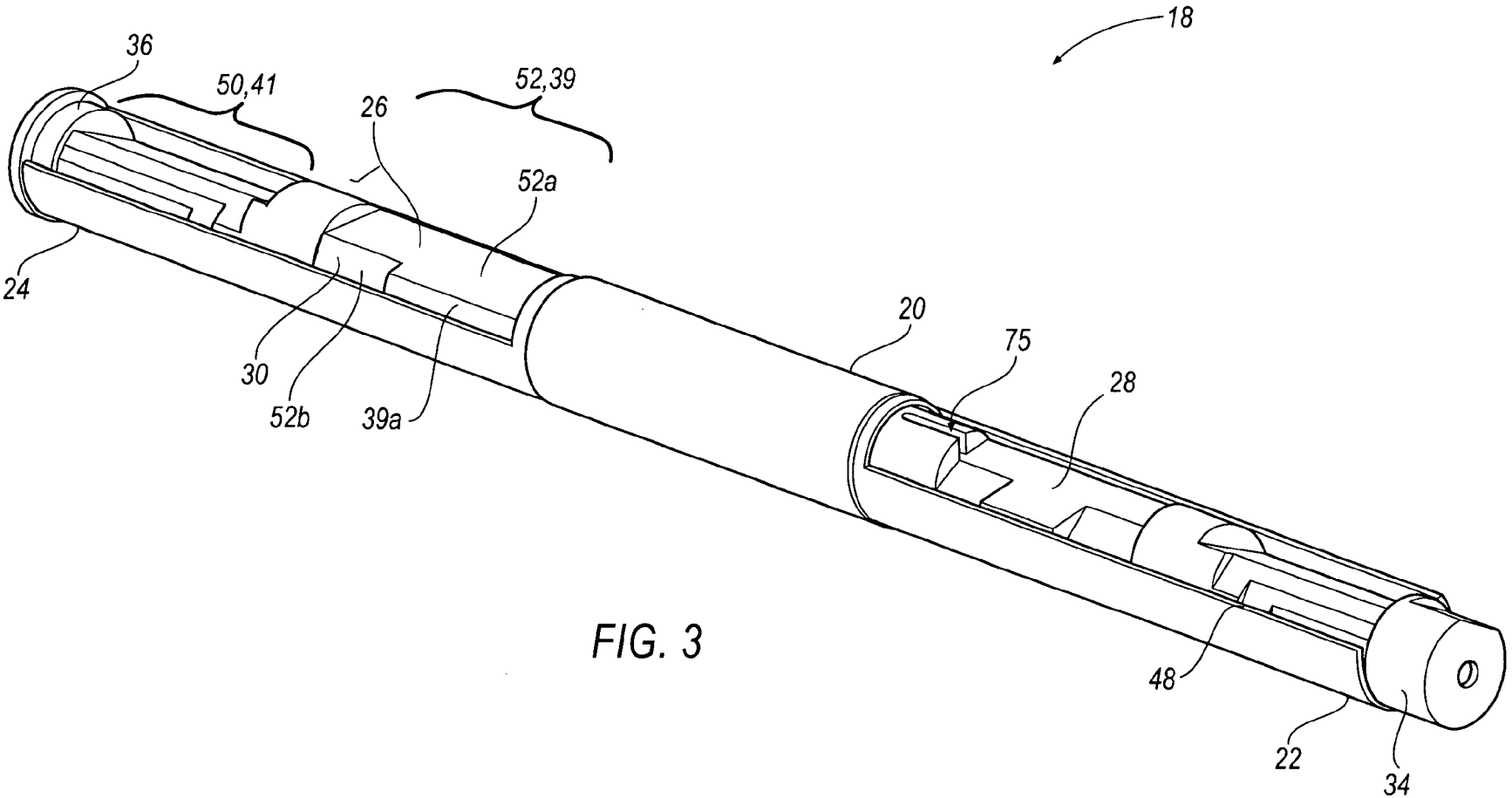
FIG. 3 is a perspective view of the bar of the weight-training apparatus shown in FIG. 1A.

In this particular embodiment, weight-training apparatus 10 includes four heavy weight plates 12*a* and 12*b*, two plates being positioned at end 28 and two matching plates positioned at end 30. Lobes 39*a* and 39*b* and recessed surfaces 52*a* and 52*b* are included at opposing ends 28 and 30 of outer shaft 26. As illustrated by FIGS. 3 and 4, recessed surface 52*b* is shorter than recessed surfaces 52*a* and lobe 39*b* is longer than lobe 39*a*. As interior selector ring 72 is rotated in the first direction, lobes 39*a* of outer shaft 26 engage interference protrusions 70 of weight plates 12*a* to lock those weight plates to bar 18. Lobes 39*b* are not in engagement with protrusions 70 of weight plates 12*b*, so they are not locked to bar 18. Apparatus 10 may now be removed from holder 38 with weight plates 12*a* only coupled to bar 18. As interior selector ring 72 is rotated still further in the first direction, lobes 39*b* of outer shaft 26 now engage interference protrusions 70 of weight plates 12*b* to lock those plates to bar 18. Weight plates 12*a* still remain locked to bar 18. Apparatus 10 may now be removed from holder 38 with weight plates 12*a* and 12*b* locked to bar 18.

Figure 8:
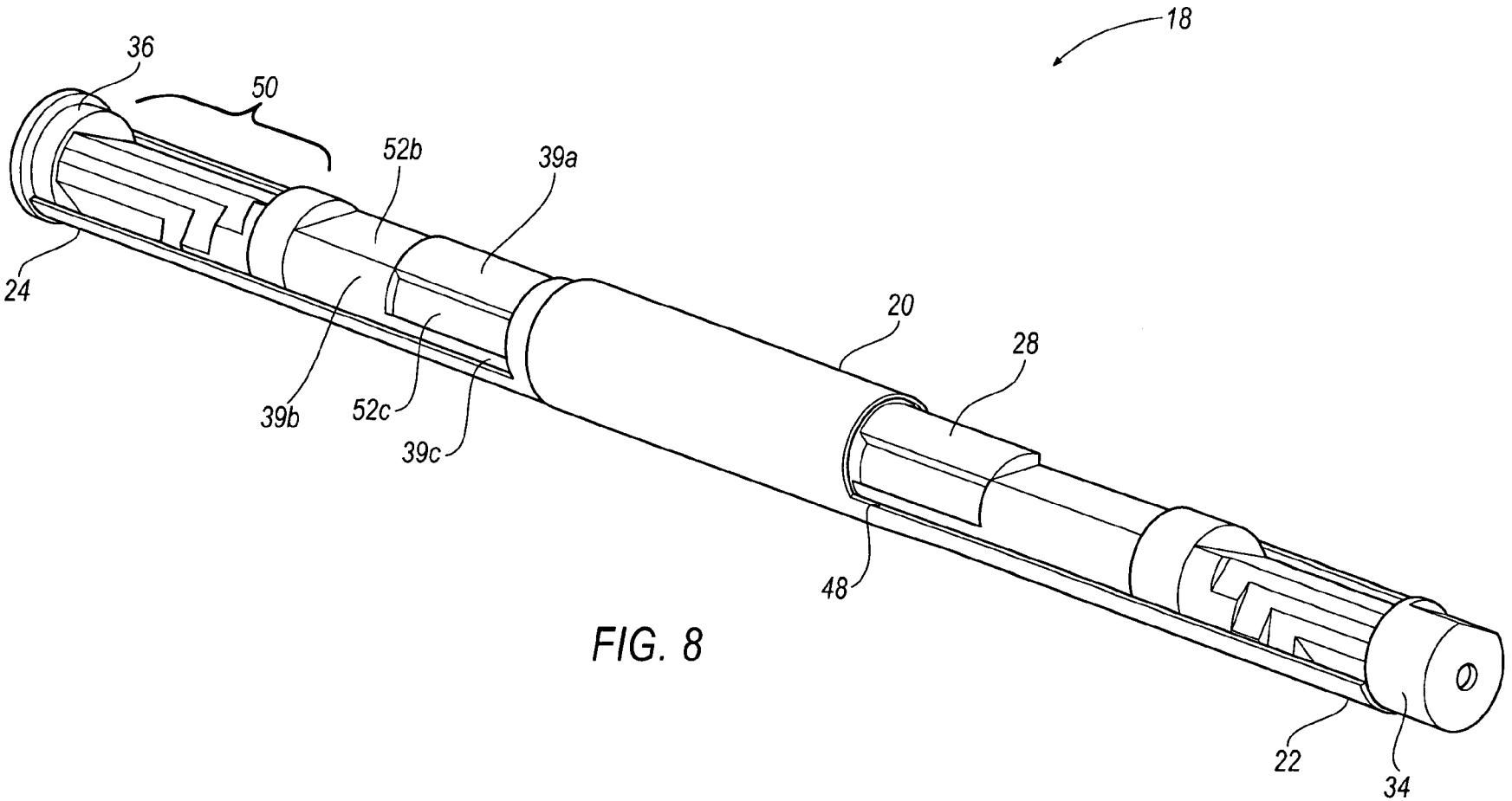
FIG. 8 is a perspective view of a bar of the weight-training apparatus according to another embodiment of the present invention.

In another embodiment of the present invention illustrated in FIG. 8, third recessed surfaces 52*c* as well as lobes 39*c* are also included on outer shaft 26 at opposing ends 28 and 30. Recessed surfaces 52*c* are positioned on outer shaft 26 between lobes 39*a* and 39*c*. The added lobes 39*c* and recessed surfaces 52*c* allow for weight plates 12*b*, independently of weight plates 12*a*, to be locked to bar 18. With weight plates 12*a* coupled to bar 18 as described above, interior selector ring 72 may be rotated in the first direction such that lobes 39*a* are rotated out of engagement with protrusions 70 of weight plates 12*a*. At the same time, lobes 39*b* of outer shaft 26 are rotated into engagement with interference protrusions 70 of weight plates 12*b* as described above. In this manner, weight plates 12*b*, but not weight plates 12*a*, will be coupled to bar 18 when apparatus 10 is removed from holder 38. This provides a wider range of weight plate combinations for the user. Interior selector ring 72 may be rotated still further in the first direction so that lobes 39*c* engage protrusions 70 of weight plates 12*a*, thereby locking both weight plates 12*a* and 12*b* to bar 18.

Referring again to FIGS. 1A–7C, in this particular embodiment, weight-training apparatus 10 includes eight lighter weight plates 12*c*, four plates being positioned at extension 34 and four matching plates positioned at extension 36. Shaft extensions 34 and 36 include lobes 41*a*, 41*b*, 41*c*, and 41*d* and recessed surfaces 50*a*, 50*b*, 50*c*, and 50*d*. As illustrated by FIGS. 3 and 4, recessed surfaces 50*d* are the shortest recessed surfaces followed by recessed surfaces 50*c*, 50*b*, and 50*a*, and lobes 41*d* are the longest followed by lobes 41*c*, 41*b*, and 41*a*. As exterior selector dial 78 is rotated in the first direction, lobes 41*a* of extensions 34 and 36 engage interference protrusions 70, thereby locking the innermost weight plates 12*c* to bar 18. Lobes 41*b*, 41*c*, and 41*d* are not in engagement with protrusions 70 of the three pairs of remaining weight plates 12*c*. Apparatus 10 may be removed from holder 38 with the innermost weight plates 12*c* only locked to bar 18. Exterior selector dial 78 may be rotated further in the first direction to move lobes 41*b* into engagement with protrusions 70 of the second pair of weight plates 12*c*. Exterior selector dial 78 may be rotated still further in the first direction so that lobes 41*c* and finally lobes 41*d* will engage protrusions 70 of the remaining pairs of weight plates, thereby locking all four pairs of weight plates 12*c* to bar 18.

Interior selector ring 72 may be rotated in a second direction, opposite the first direction described above, to unlock weight plates 12*a* and 12*b* from bar 18. Exterior selector dial 78 may be rotated in either a second direction, opposite the first direction described above, or may continue to be rotated in the first direction to unlock weight plates 12*c* from bar 18. In particular, with both interior selector ring 72 and exterior selector dial 78 being rotated in the second direction, lobes 39*a*, 39*b*, 41*a*, 41*b*, 41*c*, and 41*d* will successively disengage their respective interference protrusions 70 as interior selector ring 72 and exterior selector dial 78 are rotated in the second direction. As the lobes are disengaging the protrusions, recessed surfaces 50*a*, 50*b*, 50*c*, 50*d*, 52*a*, and 52*b* will be successively positioned parallel and adjacent to second sides 68 of slots 16. If rotating of exterior selector dial 78 is continued in a first direction, all weight plates 12*c* will be unlocked from bar 18 at the same time as lobes 41*a*–41*d* are rotated out of engagement with protrusions 70 and recessed surface 50*a* is positioned parallel and adjacent to second sides 68 of slots 16. In this manner, the horizontal width of outer shaft 26 as well as inner shaft extensions 34 and 36 in combination with sleeve 20, through the so positioned recessed surface or surfaces, will be less than the width of slots 16 (see e.g. FIGS. 2B and 2C). Therefore, lobes 39 of outer shaft 26 and lobes 41 of extensions 34 and 36 will not engage the interference protrusions 70, thereby unlocking weight plates 12 from bar 18 and allowing bar 18 to slide upward out of slots 16 as apparatus 10 is lifted out of holder 38.

Note that channels 48 of sleeve 20 are always parallel and adjacent to second sides 68 of slots 16. When apparatus 10 is in the release position (i.e. lobes 39, 41 are not engaging protrusions 70), opposing ends 28 and 30 of outer shaft 26, and shaft extensions 34 and 36 of inner shaft 32 are also always parallel and adjacent to second sides 68 of slots 16 so that sleeve 20, along with outer shaft 26 as well as extensions 34 and 36 will slide in slots 16 of weight plates 12 (see e.g. FIGS. 2B and 2C).

Weight-training apparatus 10 may be stored in holder 38 as illustrated by FIGS. 1A, 6A, and 6B. Holder 38 is preferably rectangular and has a generally flat top surface 87 and bottom surface 88. Holder 38 contains a series of depressions 90 that correspond to the shape of an outer rim 92 of each of weight plate pairs 12*a*, 12*b*, and 12*c*. In addition, holder 38 may include depressions 94 that correspond to that shape of dividers 44. Top surface 87 may include a flat perimeter edge 96 that will prevent weight plates 12 placed therein from sliding out of depressions 90. As discussed above, holder 38 further includes release mechanisms 40 and 42 for unlocking both interior selector ring 72 and exterior selector dial 78 so that they may be rotated in the manner described above to lock weight plates 12 to bar 18.

Figure 9:
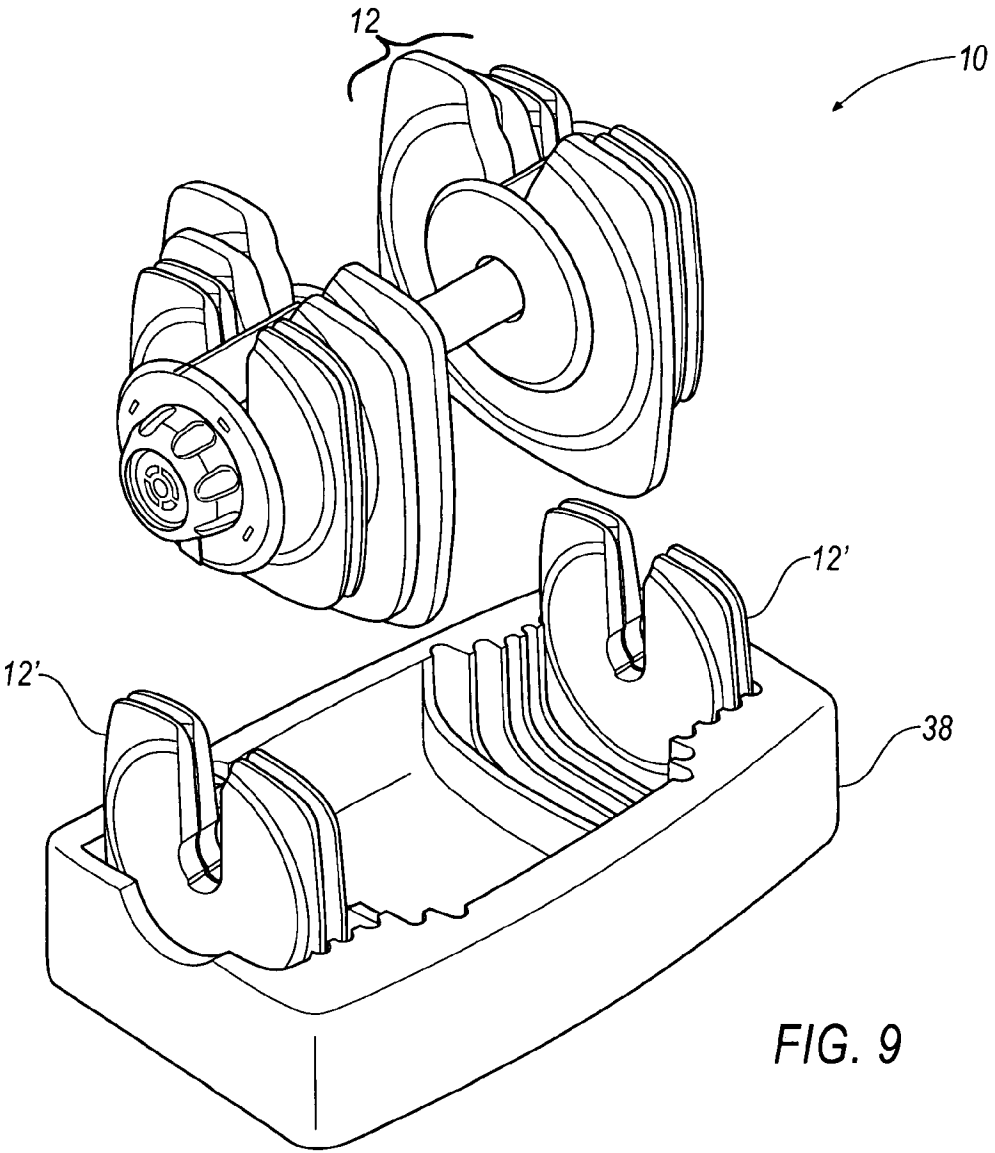
FIG. 9 is a perspective view of the weight-training apparatus shown in FIG. 1A with selected weights attached to the bar and deselected weights positioned in the holder.

When stored, weight-training apparatus 10, including bar 18 and weight plates 12 locked thereto, is securely retained in holder 38 so that weight-training apparatus 10 may be conveniently withdrawn from holder 38. As illustrated in FIG. 9, weight-training apparatus 10 is withdrawn from holder 38 and has only some of weight plates 12 locked to bar 18, while some of weight plates 12' remain securely stored in holder 38. To ensure that weight plates 12 not locked to bar 18 remain securely in holder 38, depressions 90 are sufficiently deep to prevent tipping of plates 12'. The user may change the weight of weight-training apparatus 10 by replacing it into holder 38 and adjusting interior selector dial 72 and/or exterior selector dial 78 to lock or release weight plates 12 as desired from bar 18. Because weight plates 12 do not need to be retrieved or assembled onto bar 18, and no collars are required to retain weight plates 12, nearly constant activity may be maintained and, therefore, the user can complete a workout, aerobic or anaerobic, in a minimum amount of time and rather conveniently. Locking members 82 and 84 also increase the overall safety of weight-training apparatus 10 by preventing the rotation of interior selector ring 72 and exterior selector dial 78 while weight-training apparatus is out of holder 38 and in use. The heavier weight plates 12*a* and 12*b* offer users a wider range of weight selections as well.

In the previously described embodiments of the present invention, both inner shaft 32 and outer shaft 26 have been described as being positionable to select pairs of weight plates, one weight plate at either end of bar 18. A single exterior selector dial 78 controls the rotation of inner shaft 32 and the locking or unlocking of matched pairs of weight plates 12*c* to bar 18 at shaft extensions 34 and 36. A single interior selector ring 72 controls the rotation of outer shaft 26 and the locking and unlocking of matched pairs of weight plates 12*a* and/or 12*b* to bar 18 at opposing ends 28 and 30. In another embodiment of the present invention, both outer shaft 26 and inner shaft 32 may be split into two axially aligned and spaced segments within sleeve 20 so that upon rotation of inner shaft 32 at extension 34 and/or outer shaft 26 at end 28, only one weight plate 12*a*, 12*b*, and/or 12*c* of the matched pair will be locked to bar 18. In this particular embodiment, a second exterior dial and a second interior ring are added to apparatus 10 so that the other portions of inner shaft 32 and outer shaft 26, respectively, may be rotated to engage or disengage weight plates 12*c*, 12*a*, and/or 12*b* at the opposite end of bar 18. Providing users with multiple selection options increases the number of weight combinations that may be achieved to be used during particular exercises.

Weight-training apparatus 10, weight plates 12, and holder 38 are designed asymmetrical with respect to each other. Weight-training apparatus 10 may only be seated in holder 38 in one position with respect to holder 38 and weight plates 12. If apparatus 10 is incorrectly positioned with respect to weight plates 12 (i.e. bar 18 of apparatus 10 is positioned in slots 16, such that channel 48 is adjacent tangential side 66 of plates 12 rather than second side 68), weight plates 12 will be prevented from locking to apparatus 10 because outer and inner shaft 26 and 32 cannot rotate through side 66 into hole 14. Also, if apparatus 10 is incorrectly positioned with respect to holder 38, projections 40 and 42 of holder 38 will be unable to engage locking members 82 and 84 of apparatus 10; locking member 82 and 84 will be at the opposing end of holder 38 and away from projections 40 and 42. Pins 86 of locking members 82 and 84 will remain positioned in recess 83 and 85 and continue to prevent the rotation of outer and inner shafts 26 and 32; thereby ensuring that plates 12 cannot be locked or unlocked to bar 18 when apparatus 10 is not properly positioned in holder 38. These asymmetries add to the safety features of apparatus 10 by preventing outer and inner shafts from being rotated if not correctly positioned in holder 38 as well as maintaining the balance of apparatus 10 during use by ensuring that an equal amount of weight is secured to both sides of apparatus 10.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. An adjustable weight-training apparatus, comprising:

a plurality of weight plates, each of said weight plates having a protrusion, said weight-training apparatus having longitudinally opposing end portions, each of said ends portions having longitudinally outer and inner groups of said weight plates; and a rotatable bar comprising an inner control shaft and an outer control shaft, said inner control shaft configured to rotate within and independently of said outer control shaft and said rotatable bar configured to rotate within central holes of said weight plates:

said inner control shaft having a first plurality of longitudinally spaced lobes, said inner control shaft being rotatable to position selected ones of said first plurality of lobes in engagement with said protrusions of selected weight plates of at least one of said outer groups of weight plates to secure said selected weight plates of said outer groups to said inner control shaft; and said outer control shaft having a second plurality of longitudinally spaced lobes, said outer control shaft being rotatable to position selected ones of said second plurality of lobes in engagement with said protrusions of selected weight plates of at least one of said inner groups of weight plates to secure said selected weight plates of said inner groups to said outer control shaft.

2. The adjustable weight-training apparatus as recited in claim 1, further including a non-rotatable sleeve extending through said central holes, said rotatable bar being configured to rotate within said sleeve.

3. The adjustable weight-training apparatus as recited in claim 2, further including fins extending outwardly from and secured to said sleeve, said fins sized to pass through a slot of each of said weight plates, said slot extending generally vertically upwardly from said central hole to a periphery of said weight plates.

4. The adjustable weight-training apparatus as recited in claim 2, wherein said sleeve includes a pair of channels positioned at opposing ends thereof and configured to expose said first and second plurality of longitudinally spaced lobes.

5. The adjustable weight-training apparatus as recited in claim 2, further including an interior selector ring attached to said outer control shaft for rotation therewith.

6. The adjustable weight-training apparatus as recited in claim 5, further including a pair of interior dividers extending radially outwardly from said sleeve, one of said interior dividers being positioned proximate each of said inner groups of weight plates such that a gripping area is defined between said interior dividers.

7. The adjustable weight-training apparatus as recited in claim 6, wherein said gripping area is sized to provide one-handed access.

8. The adjustable weight-training apparatus as recited in claim 6, wherein abutting faces of one of said interior dividers and said interior selector ring include a detent device to resiliently retain said inner selector ring and said outer control shaft in a manually selected rotational position.

9. The adjustable weight-training apparatus as recited in claim 2, further including an exterior selector dial attached to said inner control shaft for rotation therewith.

10. The adjustable weight-training apparatus as recited in claim 9, further including an exterior divider positioned proximate each of said outer groups of weight plates.

11. The adjustable weight-training apparatus as recited in claim 10, wherein abutting faces of one of said exterior dividers and said exterior selector dial include a detent device to resiliently retain said exterior selector ring and said inner control shaft in a manually selected rotational position.

12. The adjustable weight-training apparatus as recited in claim 1, further including a holder, said holder including a plurality of depressions sized to accept and properly position said outer and inner groups of weight plates for connection to said rotatable bar.

13. The adjustable weight-training apparatus as recited in claim 12, further including locking means operable to normally prevent rotation of said inner and outer control shafts except when said apparatus is seated in said holder.

14. An adjustable weight-training apparatus, comprising:

a plurality of weight plates, each of said weight plates having a central hole and a slot, said slot extending generally vertically upwardly from said central hole to a periphery of said weight plate, the width of said slot being smaller than the diameter of said central hole, and the intersection of one side of said slot and said central hole forming a protrusion, said weight-training apparatus having longitudinally opposing end portions, each of said end portions having longitudinally outer and inner groups of said weight plates;

a rotatable bar comprising an inner control shaft and an outer control shaft, said inner control shaft configured to rotate within and independently of said outer control shaft and said rotatable bar configured to rotate within said central holes;

said inner control shaft having a first plurality of longitudinally spaced lobes, said inner control shaft being rotatable to position selected ones of said first plurality of lobes in engagement with said protrusions of said central holes of selected weight plates of said outer groups of weight plates, to secure said selected weight plates of said outer groups to said inner control shaft; and said outer control shaft having a second plurality of longitudinally spaced lobes, said outer control shaft being rotatable to position selected ones of said second plurality of lobes in engagement with said protrusions of said central holes of selected weight plates of said inner groups of weight plates, to secure said selected weight plates of said inner groups to said outer control shaft; and a non-rotatable sleeve extending through said central holes, said rotatable bar being configured to rotate within said sleeve, said sleeve including a pair of channels positioned at opposing ends thereof and configured to expose said first and second plurality of longitudinally spaced lobes.

15. The adjustable weight-training apparatus as recited in claim 14, further including an interior selector ring attached to said outer control shaft for rotation therewith.

16. The adjustable weight-training apparatus as recited in claim 14, further including an exterior selector dial attached to said inner control shaft for rotation therewith.

17. The adjustable weight-training apparatus as recited in claim 14, further including fins extending outwardly from and secured to said sleeve, said fins sized to pass through said slots of said weight plates.

18. The adjustable weight-training apparatus as recited in claim 14, further including a pair of interior dividers extending radially outwardly from said sleeve, one of said interior dividers being positioned proximate each of said inner groups of weight plates such that a gripping area is defined between said interior dividers.

19. The adjustable weight-training apparatus as recited in claim 18, wherein said gripping area is sized to provide one-handed access.

20. The adjustable weight-training apparatus as recited in claim 18, wherein abutting faces of one of said interior dividers and said interior selector ring include a detent device to resiliently retain said inner selector ring and said outer control shaft in a manually selected rotational position.

21. The adjustable weight-training apparatus as recited in claim 14, further including an exterior divider positioned proximate each of said outer groups of weight plates.

22. The adjustable weight-training apparatus as recited in claim 21, wherein abutting faces of one of said exterior dividers and said exterior selector dial include a detent device to resiliently retain said exterior selector dial and said inner control shaft in a manually selected rotational position.

23. The adjustable weight-training apparatus as recited in claim 14, further including a holder, said holder including a plurality of depressions sized to accept and properly position said outer and inner groups of weight plates for connection to said rotatable bar.

24. The adjustable weight-training apparatus as recited in claim 23, further including locking means operable to normally prevent rotation of said inner and outer control shafts except when said apparatus is seated in said holder.

25. The adjustable weight-training apparatus as recited in claim 14, wherein said channels of said sleeve and said inner and outer shafts are configured and dimensioned such that when said inner and outer shafts are rotated to position at least one of said lobes to engage said protrusions of weight plates that are selected for connection to said rotatable bar, upward movement of said rotatable bar and sleeve lifts said selected weight plates upwardly, whereas all of said lobes that are not positioned to engage said protrusions of non-selected weight plates permit said rotatable bar and said sleeve to freely pass upwardly through said slots of said non-selected weight plates without lifting said non-selected weight plates.

26. The adjustable weight-training apparatus as recited in claim 1, wherein said inner control shaft includes inner shaft extensions coupled to opposing ends of said inner control shaft for rotation therewith, each of said inner shaft extensions projecting longitudinally beyond a respective opposing end of said outer control shaft, and said first plurality of longitudinally spaced lobes being located on each of said inner shaft extensions, whereby said inner control shaft is rotatable to simultaneously secure selected weights from each of said outer groups of weight plates at each of said end portions of said apparatus to said inner control shaft;

and wherein said second plurality of longitudinally spaced lobes are positioned in proximity to said opposed ends of said outer control shaft, whereby said outer control shaft is rotatable to simultaneously secure selected weights from each of said inner groups of weight plates at each of said end portions of said apparatus to said outer control shaft.

27. The adjustable weight-training apparatus as recited in claim 14, wherein said inner control shaft includes inner shaft extensions coupled to opposing ends of said inner control shaft for rotation therewith, each of said inner shaft extensions projecting longitudinally beyond a respective opposing end of said outer control shaft, and said first plurality of longitudinally spaced lobes being located on each of said inner shaft extensions, whereby said inner control shaft is rotatable to simultaneously secure selected weights from said outer groups of weight plates at each of said end portions of said apparatus to said inner control shaft;

and wherein said second plurality of longitudinally spaced lobes are positioned in proximity to said opposed ends of said outer control shaft, whereby said outer control shaft is rotatable to simultaneously secure selected weights from said inner groups of weight plates at each of said end portions of said apparatus to said outer control shaft.

28. In a weight-training apparatus of the type having a plurality of longitudinally spaced weight plates arranged in groups adjacent the opposite end portions of the apparatus, the weight plates each having a central hole and a slot extending generally vertically upwardly from said central hole to a periphery of said weight plate, the width of said slot being smaller than the diameter of said central hole, and the intersection of one side of said slot and said central hole forming a protrusion, and a rotatable bar passing through said central holes and provided with a plurality of longitudinally spaced lobes selectively engageable with selected ones of said protrusions upon rotation of said bar, the improved method of selecting weight plates for securement to said bar comprising:

forming said bar of coaxial and independently rotatable inner and outer control shafts, said inner control shaft being rotatable within said outer control shaft;

rotating said inner control shaft to one or more predetermined positions to secure selected weight plates from a first sub-set of weight plates located adjacent the opposite end portions of the apparatus to said inner control shaft, and rotating said inner control shaft to other predetermined positions to unlock selected weights from said inner control shaft;

rotating said outer control shaft to one or more predetermined positions to secure selected weight plates from a second sub-set of weight plates located adjacent the opposite end portions of the apparatus to said outer control shaft, and rotating said outer control shaft to other predetermined positions to unlock selected weights from said outer control shaft, said first and second sub-sets of weight plates being mutually exclusive.

29. The method of claim 28 wherein rotation of said inner control shaft simultaneously selects corresponding weight plates from said first sub-set of weight plates at both opposite end portions of the apparatus.

30. The method of claim 28 wherein rotation of said outer control shaft simultaneously selects corresponding weight plates from said second sub-set of weight plates at both opposite end portions of the apparatus.

* * * * *